United States Patent [19]

Germann et al.

[11] Patent Number: 4,584,940

[45] Date of Patent: Apr. 29, 1986

[54] INKING UNIT FOR ROTARY PRINTING MACHINE

[75] Inventors: Albrecht J. Germann; Jürgen F. F. Münker; Erich G. Wieland, all of Würzburg, Fed. Rep. of Germany

[73] Assignee: Koenig & Bauer AG, Fed. Rep. of Germany

[21] Appl. No.: 650,731

[22] Filed: Sep. 14, 1984

[30] Foreign Application Priority Data

Sep. 23, 1983 [DE] Fed. Rep. of Germany ..... 3334470

[51] Int. Cl.[4] ..... B41F 7/36

[52] U.S. Cl. ..... 101/350; 101/148

[58] Field of Search ..... 101/350, 148

[56] References Cited

U.S. PATENT DOCUMENTS

| | | | |
|---|---|---|---|
| 652,113 | 6/1900 | Jacobus . | |
| 2,972,303 | 2/1961 | De Marchi et al. | 101/350 |
| 3,345,941 | 10/1967 | Koch et al. | 101/350 |
| 3,448,686 | 6/1969 | Bohman | 101/148 |
| 3,508,489 | 4/1970 | Norton | 101/148 |
| 3,902,415 | 9/1975 | Fischer | 101/148 |
| 4,421,027 | 12/1983 | Fischer | 101/148 |
| 4,461,208 | 7/1984 | Ghisalberti | 101/350 |
| 4,530,284 | 7/1985 | Fischer | 101/350 |

FOREIGN PATENT DOCUMENTS

| | | |
|---|---|---|
| 496754 | 10/1953 | Canada . |
| 678543 | 7/1939 | Fed. Rep. of Germany . |
| 2222581 | 11/1973 | Fed. Rep. of Germany . |
| 2301692 | 7/1974 | Fed. Rep. of Germany . |
| 2845932 | 4/1980 | Fed. Rep. of Germany . |
| 2902230 | 7/1980 | Fed. Rep. of Germany . |

OTHER PUBLICATIONS

"Untersuchungen von rückwirkungsfreien Farbauftragssystemen im Offsetdruck", Deutsche Forschungsgesellschaft für Druck und Reproduktionstechnik e.V., Forschungsbericht 3.230, May 1981.

*Primary Examiner*—William Pieprz

*Attorney, Agent, or Firm*—Jones, Tullar & Cooper

[57] ABSTRACT

An offset inking unit for a rotary printing machine is disclosed. A single supply of ink, carried from an ink fountain through a distribution train that includes serially placed synthetic material coated ink receiving rollers and rubber coated ink intermediate rollers, is split by a distributing roller onto first and second ink forme rollers. The second ink forme roller has three subsequent ink forme rollers linked to it in a serial manner through rider rollers. Ink tack or stickiness is controlled to avoid ghosting by applying dampening fluid to either the first or last of the ink forme rollers or to both, if desired.

5 Claims, 2 Drawing Figures

INKING UNIT FOR ROTARY PRINTING MACHINE

FIELD OF THE INVENTION

The present invention is directed generally to an inking unit for a rotary printing machine. More particularly, the present invention is directed to an inking unit for an offset printing machine. Most specifically, the present invention is directed to an offset inking unit with a dampening assembly for a rotary printing machine. A plurality of ink forme rollers are placed about the periphery of a forme cylinder and ink a printing forme or plate carried by the forme cylinder. The ink supplied to the ink forme rollers follows a path which insures that the tack or stickiness of the ink layers built up on the printing plate carried on the forme cylinder is controlled in a manner which prevents ghosting.

DESCRIPTION OF THE PRIOR ART

Inking assemblies for use with rotary printing machines and their methods of operation are generally known in the art. The purpose of these assemblies is to transfer printing ink from a source of supply, such as an ink fountain, to a point of use, such as a plate carried by a plate cylinder. The application of the ink to the plate cylinder must be accomplished in a manner which imparts a smooth, uniform coating to the printing plate. Too much ink results in blurred, unclear printing while too little ink results in a printed product too light to read.

Many printing proceedures include the use of dampening fluid which is typically applied to the plates carried on the plate cylinders and which is carried on the portions of the plates which do not receive ink. The dampening fluid is typically applied to only one or selected ones of the plates and tends to be spread about during the operation of the press.

Addition of damping fluid to the ink being applied to the printing plate reduces the stickiness or tackiness of the ink. If an ink applying cylinder having ink not including some damping fluid, contacts a surface of a plate cylinder that has been inked with an ink and damping fluid mixture, the ink without admixed dampening fluid, and thus having a greater amount of tack, will pull the less sticky ink and damping fluid off the plate surface thereby causing ghosting.

An example of an offset inking unit may be seen in Canadian Pat. No. 496754 in which there is shown the placement of four ink forme cylinders about an offset printing plate. A stream of ink is directed toward the forme cylinders and is split into two streams, a first which is conducted to the first two ink forme rollers and a second which is conducted to the two rear ink forme rollers. As the two front ink forme rollers are in contact with the damping fluid, their tack is reduced. Thus the ink applied to the rear ink forme rollers, whose tack has not been reduced, instead of being removed from the ink forme rollers and adhereing to the printing plate, instead removes the less tacky ink and dampening fluid from the printing plate rolls, thereby promoting ghosting.

In "Untersuchungen von Rückwirkungsfrein Farbauftragssystemen im Offsetdruck", Deutsche Forschungsgesellschaft für Druck und Reproductionstechnik e.V., Forschungsbericht No. 3,230, May 1981, FIG. 8 and accompanying text, an inking unit for a letterpress rotary printing machine with a group of smoothing out rollers is disclosed in which a single forme roller is in contact with a first roller of the group of smoothing out rollers.

SUMMARY OF THE INVENTION

It is an object of the present invention to provide an inking unit for a rotary printing machine.

Another object of the present invention is to provide an inking unit for an offset printing machine.

A further object of the present invention is to provide an offset inking unit with a dampening unit for a rotary printing machine.

Yet another object of the present invention is to provide an inking unit and method for an offset rotary printing machine.

Still a further object of the present invention is to provide an offset inking unit having an improved ink splitting operation.

Still another object of the present invention is to provide an offset inking unit and method which avoids ghosting.

As will be discussed in greater detail in the description of the preferred embodiments as set forth hereinafter, the inking unit for a rotary printing machine includes an ink fountain from which the printing ink is transferred through a number of driven and non-driven rollers to a driven distribution roller and then is split to a number of ink forme rollers which ink a printing plate or forme carried by a plate cylinder. The ink forme rollers are spaced about the periphery of the plate cylinder with the driven distribution roller being in contact with a first and second ink forme roller. The third, fourth and fifth ink forme rollers are spaced from each other by interposed rider rollers with the first of these rider rollers being in contact with the second and third ink forme rollers. A dampening transfer roller that engages a dampening fluid pan roller, is also in contact with the first ink forme roller in one embodiment and with the fifth ink forme roller in a second embodiment. Alternatively, dampening transfer rollers can be placed in contact with both the first and fifth ink forme rollers and one or the other of the dampening transfer rollers can be turned on or off, as desired.

A principal advantage of the inking unit for a rotary offset printing machine in accordance with the present invention resides in the fact that the ink tack or degree of stickiness can be properly controlled. In contrast to the prior art devices, in which it was possible to cause ghosting by contacting a printing plate which carried an ink and damping fluid combination with an ink forme roller having only ink and hence having a higher amount of tack or stickiness, the inking unit and its method of operation in accordance with the present invention insures that as the printing plate moves past a plurality of ink forme rollers, it encounters applications of ink layers with increased moisture contact and hence an equal or lesser amount of tack than the ink already on the printing plate. In this way optimum ink splitting characteristics in the inking unit can be achieved.

BRIEF DESCRIPTION OF THE DRAWINGS

While the novel features and methods of operation of the inking unit for a rotary printing machine in accordance with the present invention are set forth with particularity in the appended claims, a full and complete understanding of the invention may be had by referring to the detailed description of preferred embodiments, as set forth hereinafter, and as may be seen in the accompanying drawings in which:

DESCRIPTION OF THE PREFERRED EMBODIMENT

Before entering into a complete description of the structure and operation of the preferred embodiments of the inking unit in accordance with the present invention, it is believed that a discussion of the results to be achieved and their desirability would be appropriate. During the process of splitting the printing ink and building up of an ink layer, it is essential, if it is at all possible, that from ink forme roller to ink forme roller, as viewed in the direction of rotation of the forme cylinder and hence in the direction of travel of the printing plate, that the tack of the ink should be reduced thereby reducing the stickiness of the ink. In accordance with the present invention, the moisture content of the ink should increase from forme roller to forme roller. Since increasing moisture content, caused by increased use of dampening fluid causes a decrease in ink tack or stickiness, the inking unit is structured and operated in accordance with the present invention to insure that each newly applied layer of ink is less sticky than the one beneath it and to which it is applied. Thus as the ink layer is built up on the printing plate and as viewed from the lowest or first applied to the uppermost or most recently applied layer, the tack or stickiness is to be decreased. In this way ghosting is avoided since an ink layer on the printing plate cannot be pulled of the plate and adhered to an ink layer on a subsequent ink forme roller that has a higher degree of tack than the layer on the printing plate. In the apparatus of the present invention and in its method of operation there is no situation, as there was apt to occur in the prior art, in which a fresh subsidiary flow of ink, whose tack has not been reduced by damping fluid, can contact ink of a lesser tack previously applied to an ink forme roller or to the printing plate carried by the plate cylinder.

Figure 1:
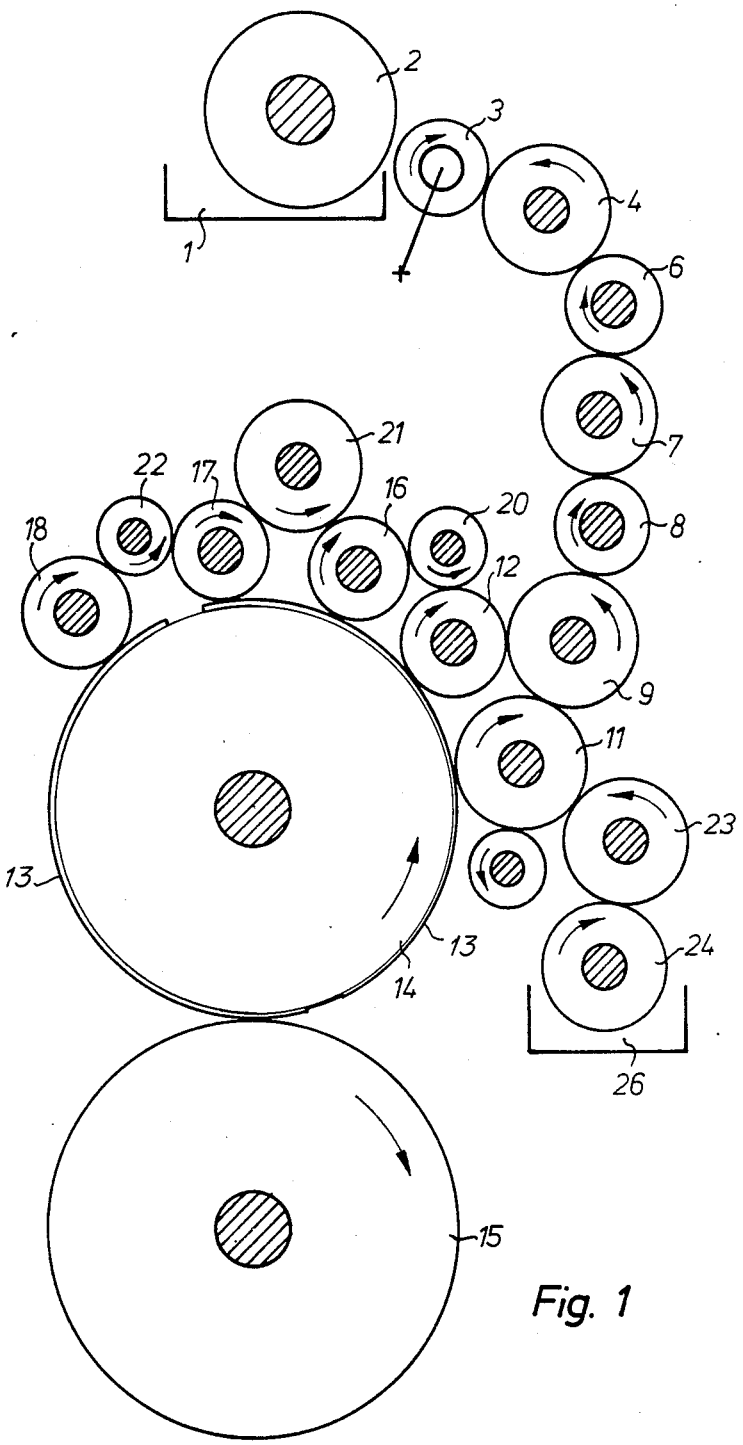
FIG. 1 is a schematic side view of a first preferred embodiment of an inking unit for a rotary printing machine in accordance with the present invention.

Referring now to FIG. 1 of the drawings, there may be seen a first preferred embodiment of an inking unit for an offset rotary printing machine in accordance with the present invention. An ink fountain 1 carries a supply of printing ink for use in a rotary printing machine. An ink fountain roller 2 is driven in a conventional manner and is caused to plunge into the ink in ink fountain 1. A messenger roller 3 oscillates between the surface of ink fountain roller 2 and a first synthetic material coated ink receiving roller 4 that is designed as a distributor roller capable of moving axially in a known manner. Oscillation of messenger roller 3 to and fro in a pendulum-like manner transfers fresh printing ink from ink fountain roller 2 to the first distributing roller 4.

A first rubber coated intermediate roller 6 contacts first ink receiving roller 4 and transfers this ink along to a second synthetic material covered ink distribution roller 7 which is, in turn, in contact with a second rubber coated intermediate roller 8. Intermediate roller 8 yields its ink coating to a third synthetic material coated distributing roller 9. It will be understood that these several synthetic material coated ink distribution rollers are capable of axial motion in a generally known manner to insure that the ink coating transferred along the train from the ink fountain roller 2 arrives at the third distribution roller 9 in an even, uniform coating.

Distributing roller 9 applies the printing ink to a first ink forme roller 11 and to a second ink forme roller 12 which both apply ink to an offset printing plate 13 secured to the periphery of a forme cylinder 14 is a known manner. The ink carried by distribution roller 9 is thus split between first ink forme roller 11 and second ink forme roller 12 before it is applied to offset printing plate 13. As may be seen in FIG. 1, a third ink forme roller 16, a fourth ink forme roller 17, and a fifth ink forme roller 18 are also positioned to contact printing plate 13 on plate clyinder 14. These several additional ink forme rollers are placed subsequent to each other in the direction of rotation of plate cylinder 14 so that printing plate 13 initially contacts ink forme roller 11 and then rollers 12, 16, 17, and 18 in that order. Ink forme rollers 16, 17, and 18 are rubber coated in a manner similar to first and second ink forme rollers 11 and 12, respectively.

A first synthetic material coated rider roller 20 is positioned above and between second and third ink forme rollers 12 and 16. Similarly, a second synthetic material coated rider roller 21 is rollingly placed between third and fourth ink forme rollers 16 and 17, respectively. Finally, a third synthetic material coated rider roller 22 rolls in contact with fourth and fifth ink forme rollers 17 and 18. It is to be noted that while each of the ink forme rollers 11, 12, 16, 17, and 18 contacts printing plate 13 on plate cylinder 14, that none of these rollers touch each other. Similarly, none of the three rider rollers 20, 21, and 22 contact either each other or the printing plate 13, instead limiting their contact to the adjacent ink forme rollers upon which they roll.

Turning again to FIG. 1, there may be seen a dampening fluid transfer roller 23 which applies dampening fluid to the first ink forme roller 11. The dampening fluid transfer roller 23 is also in contact with a dampening fluid pan roller 24 which plunges or dips into dampening fluid carried in a dampening fluid pan 26. Both the dampening fluid transfer roller 23 and the dampening fluid pan roller 24 may be driven in a generally conventional manner by a controllable electric motor or other suitable drive means.

Figure 2:
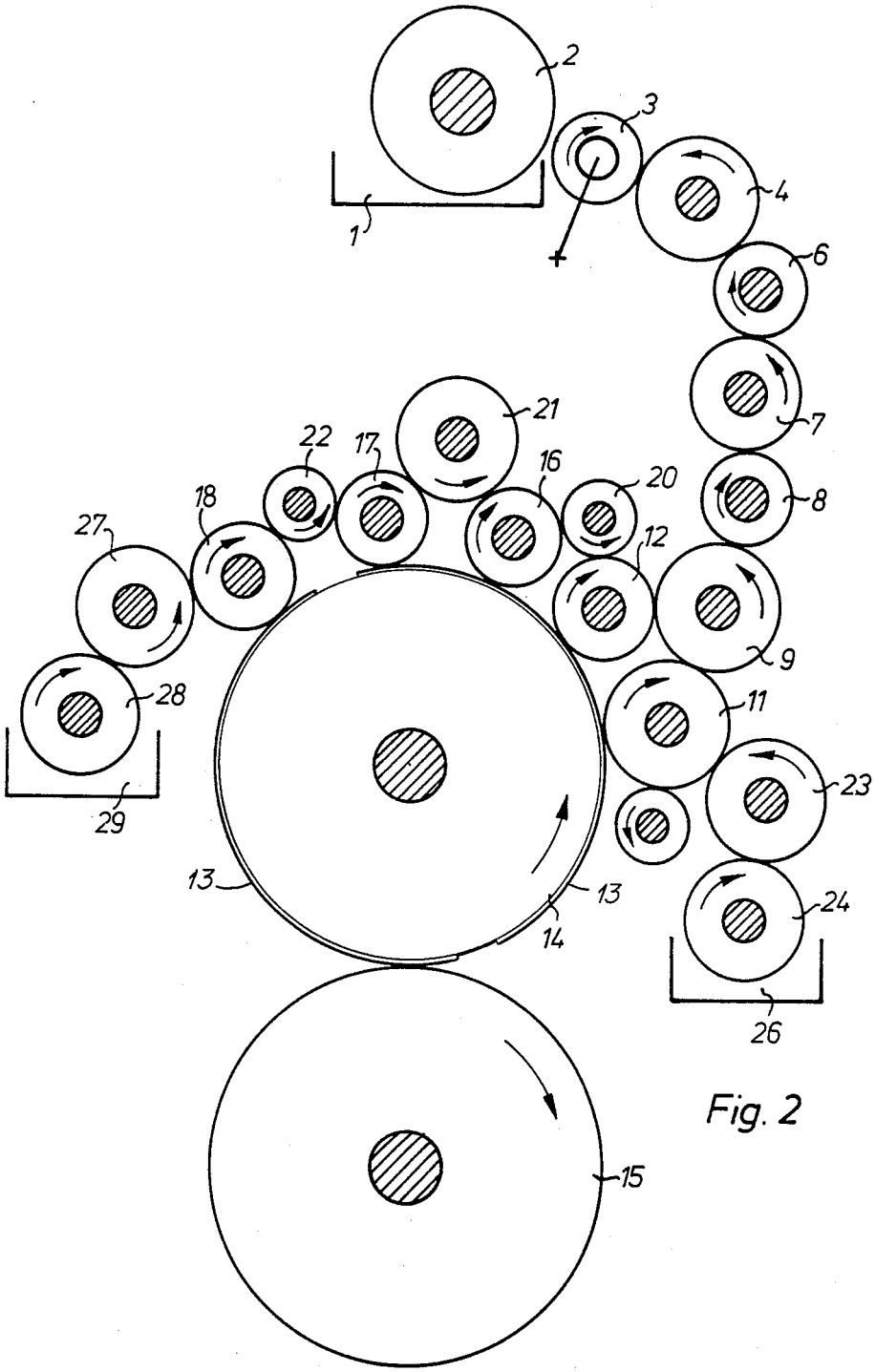
FIG. 2 is a schematic side view of a second preferred embodiment of the inking unit for a rotary printing machine in accordance with the present invention.

As an alternative to the preferred embodiment shown in FIG. 1, there may be provided a second embodiment of the inking unit in accordance with the present invention, as may be seen in FIG. 2. A second dampening fluid transfer roller 27 is placed to contact the fifth ink forme roller 18 and to apply dampening fluid to it from a second dampening fluid pan roller 28. Pan roller 28 receives dampening fluid from a second dampening fluid pan 29. As with the first preferred embodiment, both transfer roller 27 and pan roller 28 may be driven by any suitable controllable means such as an electric motor. In the second preferred embodiment, as shown in FIG. 2, both of the dampening assemblies could be operated concurrently or either one could be shut off and the other one operated.

The forme cylinder 14 and the blanket cylinder 15 are, of course, both driven by the main drive means for the press assembly. In addition, the first, second, and third ink distribution rollers 4, 7, and 9, respectively, as well as the second rider roller 21 are also positively driven by the main drive of the press. The remaining rollers of the inking system 3, 6, 8, 11, 12, 20, 16, 17, 18, and 22 are driven by frictional engagement with the rollers 4, 7, 9, 14, and 21, respectively, with which they engage.

By using the above described arrangement of ink forme rollers 11, 12, 16, 17, and 18, and their cooperating rider rollers 20, 21, and 22, it is possible to achieve the result of a decreasing ink tack of the ink on the ink forme rollers, as viewed in the direction of rotation of the forme cylinder, by using the second dampening fluid transfer roller 27 to apply dampening fluid to the last ink forme roller 27. Thus the stickiness or tack is greatest at its point of application to the first ink forme roller 11 and decreases to a minimum on the fifth ink forme roller 18, the one being supplied with dampening fluid directly from the second dampening fluid transfer roller 27. If it is desired to maintain the ink tack or stickiness essentially the same from ink forme roller to ink forme roller to thereby provide a good inking of the offset printing roller, this can be accomplished by applying dampening fluid from the first dampening fluid transfer roller 23 onto the surface of the first ink forme roller.

While preferred embodiments of an inking unit for a rotary offset printing machine in accordance with the present invention have been set forth fully and completely hereinabove, it will be obvious to one of skill in the art that a number of changes in, for example, the number of distributing rollers and intermediate rollers, the specific drive means for the dampening fluid rollers, and the drive means for the various ink forme rollers and their various associated rollers could be varied without departing from the true scope and spirit of the subject invention which is accordingly to be limited only by the following claims.

We claim:

1. A single line inking unit for a rotary offset printing machine for transferring printing ink from an ink fountain to a printing plate carried on a rotatable forme cylinder and including a first dampening unit, said inking unit comprising:

at least first and second rotatably driven ink distributing rollers, a first of said ink distributing rollers receiving the printing ink from the ink fountain and transferring it to an intermediate roller positioned between said first and second ink distributing rollers, said second ink distributing roller being rotatably driven and axially shiftable;

five ink forme rollers positioned serially about said forme cylinder and each contacting said printing plate on said forme cylinder as said forme cylinder is rotated, said second ink distributing roller being in contact with first and second ones of said ink forme rollers to supply ink to said first and said second ink forme rollers;

a first rider roller positioned between and contacting said second ink forme roller and a third ink forme roller, a second rider roller contacting said third ink forme roller and a fourth ink forme roller, and a third rider roller contacting said fourth ink forme roller and a fifth ink forme roller whereby printing ink is fed from the ink fountain to said second distributing roller and is split along said ink forme rollers; and a dampening fluid transfer roller of said first dampening unit positioned adjacent, and contacting said first ink forme roller to transfer dampening fluid to said first ink forme roller to maintain said printing ink fed to said second distributing roller and split along said five ink forme rollers at generally the same ink tack along said five ink forme rollers.

2. The single line inking unit of claim 1 further including a second dampening unit, a dampening fluid transfer roller of the second dampening unit being in contact with said fifth ink forme roller.

3. A method of applying a coating of offset printing ink containing dampening fluid to an offset printing plate in a single line inking unit of a rotary printing machine, said method including the steps of:

passing said offset printing plate past at least five serially positioned ink forme rollers which are each supplied with said ink, said ink supplied to said five ink forme rollers having decreasing tack in the direction of rotation of said offset printing plate; and applying said ink to said printing plate in a succession of layers of decreasing tack placed on top of each other to build up said coating of ink on said printing plate.

4. A single line inking unit for a rotary offset printing machine for transferring printing ink from an ink fountain to a printing plate carried on a rotatable forme cylinder and including a first dampening unit, said inking unit comprising:

at least first and second rotatably driven ink distributing rollers, a first of said ink distributing rollers receiving the printing ink from the ink fountain and transferring it to an intermediate roller positioned between said first and second ink distributing rollers, said second ink distributing roller being rotatably driven and axially shiftable;

five ink forme rollers positioned serially about said forme cylinder and each contacting said printing plate on said forme cylinder as said forme cylinder is rotated, said second ink distributing roller being in contact with first and second ones of said ink forme rollers to supply ink to said first and said second ink forme rollers;

a first rider roller positioned between, and contacting said second ink forme roller and a third ink forme roller, a second rider roller contacting said third ink forme roller and a fourth ink roller, and a third rider roller contacting said fourth ink forme roller and a fifth ink forme roller whereby printing ink is fed from the ink fountain to said second distributing roller and is split along said ink forme rollers; and a dampening fluid transfer roller of said first dampening unit positioned adjacent, and contacting said fifth ink forme roller to transfer dampening fluid to said fifth ink forme roller to maintain said printing ink fed to said second distributing roller and split along said five ink forme rollers at a maximum tack at said first ink forme roller and decreasing to a minimum tack at said fifth ink forme roller.

5. The single line inking unit of claim 4 further including a second dampening unit, a dampening fluid transfer roller of said second dampening unit being in contact with said first ink forme roller.

* * * * *